US009375094B2

(12) United States Patent
Viberg

(10) Patent No.: US 9,375,094 B2
(45) Date of Patent: Jun. 28, 2016

(54) DEVICE FOR ADJUSTING FURNITURE

(75) Inventor: Michael Viberg, Surahammar (SE)

(73) Assignee: PASS OF SWEDEN AB, Surahammar (SE)

( * ) Notice: Subject to any disclaimer, the term of this patent is extended or adjusted under 35 U.S.C. 154(b) by 618 days.

(21) Appl. No.: 13/990,304

(22) PCT Filed: Oct. 21, 2011

(86) PCT No.: PCT/EP2011/068448

§ 371 (c)(1),
(2), (4) Date: Aug. 9, 2013

(87) PCT Pub. No.: WO2012/072336

PCT Pub. Date: Jun. 7, 2012

(65) Prior Publication Data

US 2014/0053340 A1 Feb. 27, 2014

(30) Foreign Application Priority Data

Nov. 30, 2010 (EP) ..... 10193117

(51) Int. Cl.
*A47C 20/04* (2006.01)
*A47C 20/00* (2006.01)

(52) U.S. Cl.
CPC ..... *A47C 20/04* (2013.01); *A47C 20/041* (2013.01)

(58) Field of Classification Search
CPC ..... A61G 7/002; A61G 7/005; A61G 7/012; A61G 7/015; A61G 7/018; A61G 13/02; A61G 13/04; A61G 13/06; A61G 13/08; A47C 1/0242; A47C 19/12; A47C 20/04; A47C 20/041
USPC ..... 5/657, 652, 600, 610, 613, 616–618
See application file for complete search history.

(56) References Cited

U.S. PATENT DOCUMENTS 2,500,742 A * 3/1950 Taylor ..... A47C 20/041 5/616
2,856,613 A * 10/1958 Mandelko ..... A61G 7/015 5/616
3,201,806 A * 8/1965 Hutt ..... A61G 7/002 5/614

(Continued)

FOREIGN PATENT DOCUMENTS

DE 1529431 12/1969
DE 202008016980 3/2009

(Continued)

OTHER PUBLICATIONS

International Search Report for PCT/EP2011/068448, Completed by the European Patent Office on Nov. 30, 2011, 3 Pages.

*Primary Examiner* — Robert G Santos
(74) *Attorney, Agent, or Firm* — Brooks Kushman P.C.

(57) ABSTRACT

A furniture device including a fundament, a first section and a second section. The second section is adapted to be pivoted between a first orientation and a second orientation. The device includes a pivoting member with a pivot arm, a first pivot adapted to allow a first rotation (R1) of the pivot arm in relation to the fundament, and a pivoting mechanism adapted to induce the first rotation. The pivot arm having an elongated first arm, an elongated second arm and a second pivot adapted to allow a second rotation (R2) of the second arm in relation to the first arm. The pivoting mechanism is adapted to act on an outer part of the pivot arm, which outer part is located at a greater distance from the first pivot than the second pivot.

15 Claims, 5 Drawing Sheets

(56) References Cited

U.S. PATENT DOCUMENTS 3,300,794 A * 1/1967 Altorfer ..... A47C 20/041 5/616
3,402,408 A * 9/1968 Hutt ..... A61G 7/002 5/614
3,681,792 A * 8/1972 Korber ..... A47C 20/041 297/58
3,826,434 A * 7/1974 Von Beckh ..... B64D 11/0689 244/122 R
4,563,784 A * 1/1986 Shrock ..... A47C 17/17 297/342
5,161,274 A * 11/1992 Hayes ..... A47C 20/041 5/616
5,205,004 A * 4/1993 Hayes ..... A61G 7/015 5/611
5,537,701 A * 7/1996 Elliott ..... A47C 19/005 5/616
5,577,280 A * 11/1996 Elliott ..... A47C 19/005 5/617
5,740,568 A * 4/1998 Elliott ..... A47C 19/005 5/295
5,870,784 A * 2/1999 Elliott ..... A47C 19/005 5/616
6,679,555 B2 * 1/2004 Bangert ..... A47C 20/08 297/316
7,165,277 B2 * 1/2007 Taguchi ..... A61G 7/015 5/617
9,049,939 B2 * 6/2015 Viberg ..... A47C 20/041
2002/0036421 A1 * 3/2002 Bangert ..... A47C 20/041 297/316
2005/0076440 A1 * 4/2005 Taguchi ..... A61G 7/015 5/618
2014/0053340 A1 * 2/2014 Viberg ..... A47C 20/04 5/657
2014/0116168 A1 * 5/2014 Viberg ..... A47C 20/041 74/105
2015/0171703 A1 * 6/2015 Viberg ..... A47C 20/041 310/83

FOREIGN PATENT DOCUMENTS

| | | |
|---|---|---|
| FR | 2871671 | 12/2005 |
| GB | 1300963 | 12/1972 |
| WO | 2005122841 | 12/2005 |

* cited by examiner

DEVICE FOR ADJUSTING FURNITURE

CROSS-REFERENCE TO RELATED APPLICATIONS

This application is the U.S. national phase of PCT Application No. PCT/EP2011/068448 filed on Oct. 21, 2011, which claims priority to EP Patent Application No. 10193117.8 filed on Nov. 30, 2010, the disclosures of which are incorporated in their entirety by reference herein.

FIELD OF THE INVENTION

The present invention relates to a furniture device comprising a fundament in connection to the ground, a support member on the fundament. The support member comprises a first section having a first surface parallel with a first plane and a second section having a second surface. The second section is adapted to be pivoted between a first orientation and a second orientation. The second surface is parallel with the first plane in the first orientation and non-parallel with the first plane in the second orientation. The furniture device further comprises a pivoting member adapted to pivot the second section between the first and the second orientation. The pivoting member comprising at least one pivot arm with a first end and a second end, a first pivot between the first end of the pivot arm and the fundament adapted to allow a first rotation of the pivot arm in relation to the fundament so that the second end of the pivot arm acts on the second section, and a pivoting mechanism adapted to induce the first rotation.

PRIOR ART

A furniture device, such as a bed, an armchair, or other similar devices, is adapted to receive the weight or part of the weight of a being and distribute the weight from the body of the being over a part of the surface of the device. The furniture device comprises at least the first and the second section. The second section of the device is adapted to be pivoted by means of the pivoting member to different orientation in relation to the first section. In the first orientation, the furniture device is adapted to have the surface of the first section parallel with the surface of the second section, wherein the first and the second section together provide a large flat area that can be used for lying down. The second section is adapted to be pivoted to an inclination in respect to the first section, wherein the second surface is non-parallel with the first surface. In such non-parallel orientation, the second section is used for supporting the back of the being, for example when the being is in a sitting position.

The pivoting mechanism in prior art devices comprises a motor unit, such as an electric motor, that acts on a protruding part on the pivot arm in order to induce the rotation. Thereby, the protruding part is subjected to a large force, wherein the protruding part and the pivot arm require a rigidly structure in order to withstand the force from the electric motor. The requirement of a rigid structure increases the weight and the material cost of the pivot arm. Another problem with prior art devices is that the possible rotation of the device is limited. The second section can not be inclined up to 90 degrees in relation to the first section. A further problem with prior art devices is that the motor unit requires space under the fundament of the device. Thereby, the space can not be used for storage and cleaning under the fundament is difficult.

WO2005/122841 discloses a device for pivoting a second section in relation to a first section. The device comprises a fundament and a pivoting member. The pivoting member comprises a pivot arm (see FIG. 3 reference number 11, 12*a*, 12*b*), a first pivot between the pivot arm and the fundament and a pivoting mechanism adapted to induce a rotation of the pivot arm. The pivoting mechanism acts by means of an electric motor on a protruding part (see FIG. 3 reference number 13) on the pivot arm, wherein the second section is pivoted. The device has the above described problems and disadvantages.

OBJECTS AND SUMMARY OF THE INVENTION

The object of the present invention is an improved furniture device. A first object of the invention is a device that requires a less rigid pivoting arm in comparison to prior art. A second object of the invention is a device that enables the second section to be pivoted to a higher inclination in comparison to prior art. A third object of the invention is a device, which pivoting mechanism is requiring less space under the fundament in comparison to prior art.

These objects are achieved by a furniture device as initially defined, characterized in that the pivot arm comprises an elongated first arm and an elongated second arm, wherein the first arm is closer to the first pivot than the second arm, and a second pivot between the first arm and the second arm adapted to allow a second rotation of the second arm in relation to the first arm, wherein the pivoting mechanism is adapted to act on an outer part of the pivot arm, which outer part is located at a greater distance from the first pivot than the second pivot.

The pivot arm comprises the first and the second arm, which first and second arm are adapted to be rotated in relation to each other by means of the second pivot. The pivoting mechanism is adapted to act on the outer part of the pivot arm, which results in that the second rotation is initiated prior to the first rotation. Accordingly, the pivoting arm allows the pivoting mechanism to be located at a position where the pivoting mechanism does not require space under the fundament.

The pivot arm is adapted to be pivoted without applying pressure on a protruding part according to prior art. Accordingly, the pivot arm may be made of a less rigid structure than in prior art devices. Thereby, the material cost for the pivot arm is reduced. Furthermore, the weight of the device is reduced.

According to one embodiment of the invention, the elongated first arm extends along a first longitudinal axis and the elongated second arm extends along a second longitudinal axis, wherein the first rotation is consecutive to the second rotation when the second section is pivoted away from the first orientation, and wherein the second rotation is adapted to be initiated when the second longitudinal axis is parallel with the first longitudinal axis or oriented up to at a first angle with the first longitudinal axis and the first rotation is adapted to be initiated when the second longitudinal axis is oriented at a second angle with the first longitudinal axis, wherein the second angle is larger than the first angle.

According to one embodiment of the invention, the first angle between the second longitudinal axis and the first longitudinal axis is less than 15 degrees, preferably less than 5 degrees.

According to one embodiment of the invention, the second angle between the second longitudinal axis and the first longitudinal axis is less than 75 degrees, preferably less than 50 degrees.

According to one embodiment of the invention, the second arm comprises a first stop member adapted to stop the second rotation at a first inclination between the second longitudinal axis and the first longitudinal axis.

The first stop member restricts the second rotation so that the second rotation does to not exceed the first inclination between the second longitudinal axis and the first longitudinal axis. After that the second rotation has been stopped the first rotation may be initiated.

According to one embodiment of the invention, the first inclination is between 35 and 55 degrees, preferably between 40 and 50 degrees.

According to one embodiment of the invention, the first stop member protrudes away from the second longitudinal axis of the second arm, wherein the first stop member comprises a first side part adapted to abut the first arm at the first inclination between the second longitudinal axis and the first longitudinal axis.

As the first side part of the first stop member abuts the first arm the second arm is restricted from being rotated further towards the first arm. Accordingly, the first stop member sets the first inclination between the second longitudinal axis and the first longitudinal axis.

According to one embodiment of the invention, the pivot arm comprises an elongated third arm, wherein the second arm is closer to the first pivot than the third arm, and a third pivot between the second arm and the third arm adapted to allow a third rotation of the second arm in relation to the first arm, wherein the pivoting mechanism is adapted to act on the outer part of the pivot arm, which outer part is located at a greater distance from the first pivot than the third pivot, so that the pivoting mechanism induces the third rotation.

The pivot arm comprises the second and the third arm, which second and third arm are adapted to be rotated in relation to each other by means of the third pivot. The pivoting mechanism is adapted to act on the outer part of the pivot arm, which results in that the third rotation is initiated prior to the first and the second rotation.

According to one embodiment of the invention, the elongated third arm extends along a third longitudinal axis, wherein the second rotation is consecutive to the third rotation when the second section is pivoted away from the first orientation, and the third rotation is adapted to be initiated when the third longitudinal axis is parallel with the second longitudinal axis or oriented up to at a third angle with the second longitudinal axis and the second rotation is adapted to be initiated when the third longitudinal axis is oriented at a fourth angle with the second longitudinal axis, wherein the fourth angle is larger than the third angle.

According to one embodiment of the invention, the third angle between the third longitudinal axis and the second longitudinal axis is less than 15 degrees, preferably less than 5 degrees.

According to one embodiment of the invention, the fourth angle between the third longitudinal axis and the second longitudinal axis is less than 75 degrees, preferably less than 50 degrees.

According to one embodiment of the invention, the third arm comprises a second stop member adapted to stop the third rotation at a second inclination between the third longitudinal axis and the second longitudinal axis.

According to one embodiment of the invention, the second inclination is between 35 and 55 degrees, preferably between 40 and 50 degrees.

According to one embodiment of the invention, the second stop member protrudes away from the third longitudinal axis of the third arm, wherein the second stop member comprises a second side part adapted to abut the second arm at the second inclination between the third longitudinal axis and the second longitudinal axis.

The second stop member restricts the third rotation so that the third rotation does to not exceed the second inclination between the third longitudinal axis and the second longitudinal axis. After that the third rotation has been stopped the second rotation may be initiated.

According to one embodiment of the invention, the pivoting mechanism is adapted to, from the first orientation, act on the pivot arm so that the third rotation is induced, which third rotation rotates the second section from the first orientation to the second orientation.

According to one embodiment of the invention, the pivoting mechanism is adapted, from the second orientation, to act on the pivot arm so that the second rotation is induced, which second rotation rotates the second section from the second orientation to a third orientation, wherein in the second orientation the second section is inclined at a first angle with the first plane and in the third orientation the second section is inclined at a second angle with the first plane, the second angle being higher than the first angle.

According to one embodiment of the invention, the pivoting mechanism is adapted, from the third orientation, to act on the pivot arm so that the first rotation rotates the second section to a fourth orientation, wherein the fourth orientation is inclined at a third angle with the first plane and the third angle is higher than the second angle.

According to one embodiment of the invention, the pivoting mechanism comprises a motor unit attached at the second section, wherein the motor unit is pulling the pivot arm towards the motor unit when the second section is pivoted from the first orientation to the second orientation and the motor unit is pushing the pivot arm away from the motor unit when the second section is pivoted from the second orientation to the first orientation.

According to one embodiment of the invention, the device comprises a further pivot arm, each pivot arm being connected to opposite sides of the fundament by means of the first pivot, and a connection element connecting the two pivot arms together, wherein the connection element is adapted to act on the second section.

According to one embodiment of the invention, the furniture device comprises a link arm extending from a fourth pivot between the link arm and the outer part of the pivot arm to a fifth pivot between the link arm and the second section.

The link arm is adapted to allow the second section to be pivoted independently from the pivoting movement provided by the pivoting member. By means of the link arm it is assured that a person is not pinched between the second section and the fundament.

According to one embodiment of the invention, the fifth pivot is between the link arm and the connection element.

According to one embodiment of the invention, the second section comprises a guide member protruding towards the fundament, wherein the connection element is adapted to slide on the guide member. The guide member is adapted to control the response to the inclination of the second section as the pivot arm is rotated.

According to one embodiment of the invention, the guide member comprises an inner portion and outer portion, which inner portion is located closer to the motor unit than the outer portion, wherein the outer portion protrudes further away from the second section than the inner portion.

According to one embodiment of the invention, the guide member is wedge shaped.

According to one embodiment of the invention, the furniture device comprises a first support arranged at the fundament, wherein the first support is adapted to support the first arm of the pivot arm when the second section is in the first orientation. According to one embodiment of the invention, the first support is adapted to support the first arm when the second section is in the first, the second and the third orientation.

According to one embodiment of the invention, the furniture device comprises a second support arranged at the fundament, wherein the second support is adapted to support the second arm of the pivot arm when the second section is in the first orientation.

According to one embodiment of the invention, the second support is adapted to support the second arm when the second section is in the first and the second orientation.

According to one embodiment of the invention, the furniture device comprises two pivot arms arranged extending along two opposite sides of the furniture device.

BRIEF DESCRIPTION OF THE DRAWINGS

The invention will now be explained more closely by the description of different embodiments of the invention and with reference to the appended figures.

FIG. 2*a* shows a pivot arm when the device is in the first orientation.

FIG. 2*b* shows the pivot arm of FIG. 2*a* when the device is in the third orientation.

FIG. 2*c* shows a top view of two pivot arms connected by a connection member.

DETAILED DESCRIPTION OF PREFERRED EMBODIMENTS OF THE INVENTION

Figure 1A:
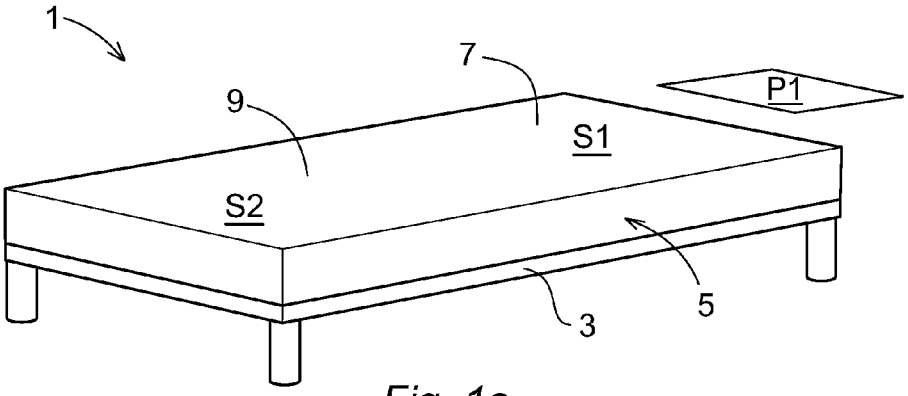
FIG. 1*a* shows a general overview of a furniture device.

A furniture device 1 is now to be described with reference to FIG. 1-6. The furniture device 1 comprises a fundament 3 in connection to the ground and a support member 5 adapted to support the weight of a being. The support member 5 is for example a mattress, a cushion, etcetera. The support member 5 may also be a support for a mattress, a cushion, etcetera.

The support member 5 comprises a first section 7 and a second section 9. The first section 7 comprises a first surface S1 parallel with a first plane P1. The second section 9 comprises a second surface S2.

The furniture device 1 further comprises a pivoting member 10 adapted to pivot the second section 9 between a first, a second, a third and a fourth orientation. It shall be understood that the pivoting member is adapted to pivot the second section to and from the first orientation and the subsequent second, third and fourth orientation.

In the first orientation the second surface S2 is parallel with the first plane P1. Thereby, the support member 5 provides a large flat surface by means of the first section 7 and the second section 9, see FIG. 1*a* and FIG. 3.

Figure 4:
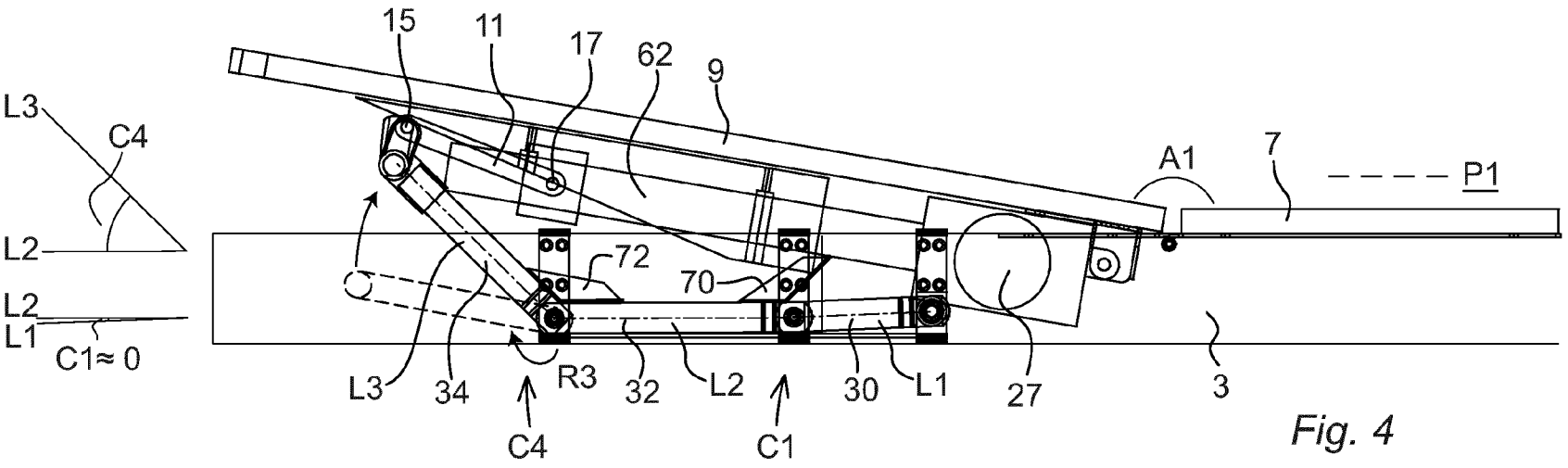
FIG. 4 shows a side view of the furniture device in FIG. 1 in the second orientation.

In the second orientation the second surface S2 is non-parallel with the first plane P1, wherein the second surface S2 is inclined at a first angle A1 in respect to the first plane P1, see FIG. 4.

Figure 5:
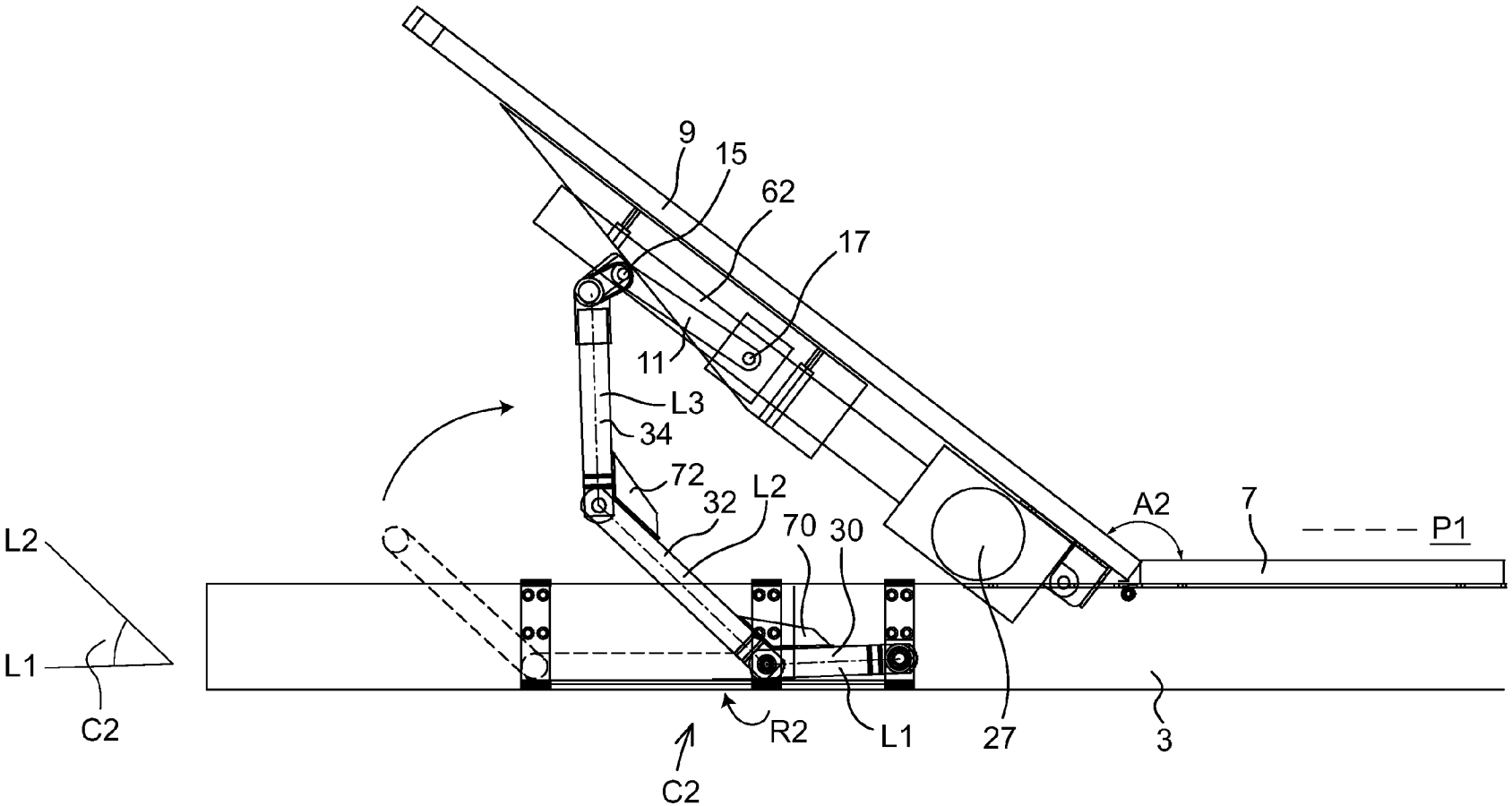
FIG. 5 shows a side view of the furniture device in FIG. 1 in the third orientation.

In the third orientation the second surface S2 is inclined at a second angle A2 in respect to the first plane P1, which second angle A2 is higher than the first angle A1, see FIG. 5.

Figure 6:
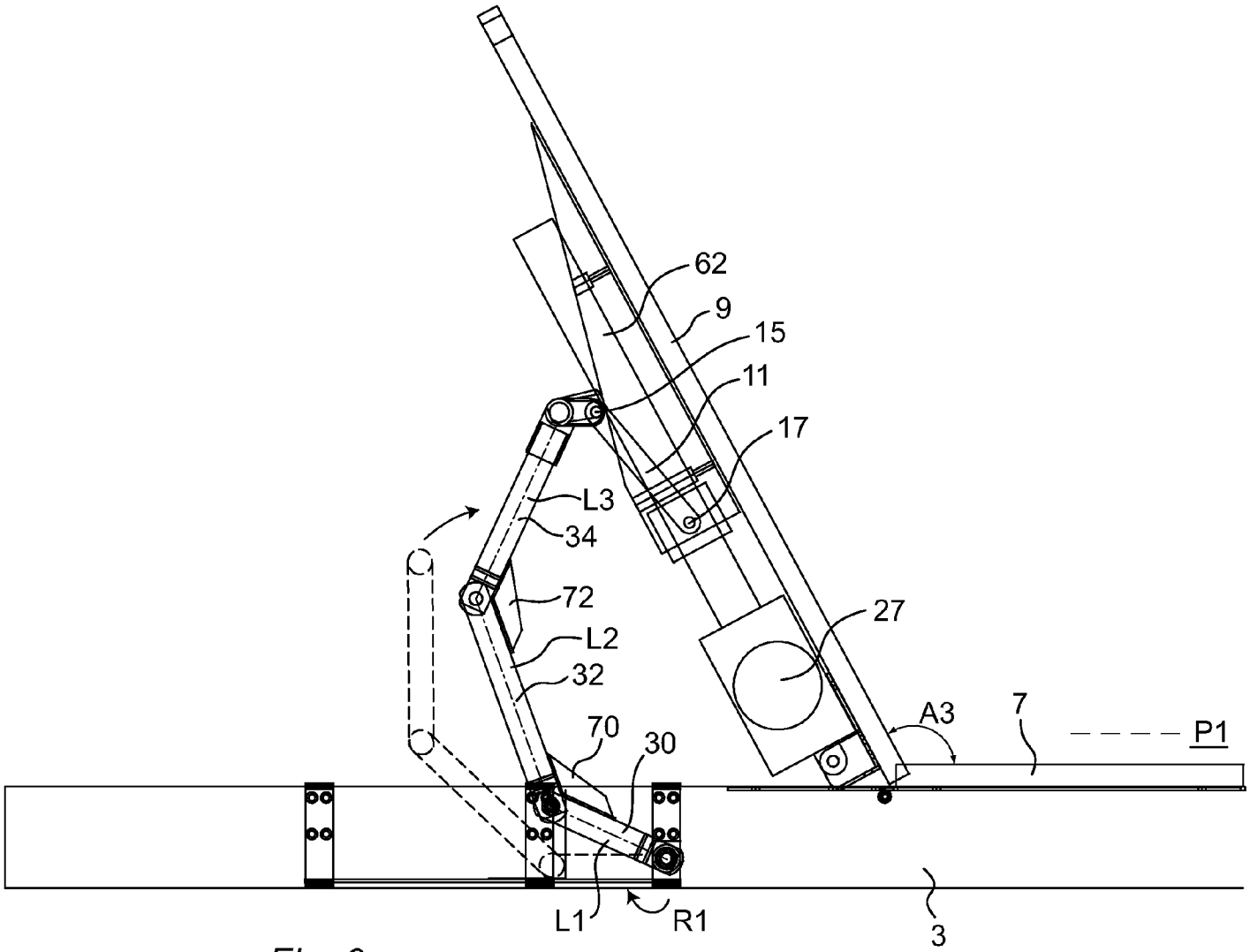
FIG. 6 shows a side view of the furniture device in FIG. 1 in the fourth orientation.

In the fourth orientation the second surface S2 is inclined at a third angle A3 in respect to the first plane P1, which third angle A3 is higher than the second angle A2, see FIG. 6.

Figure 1B:
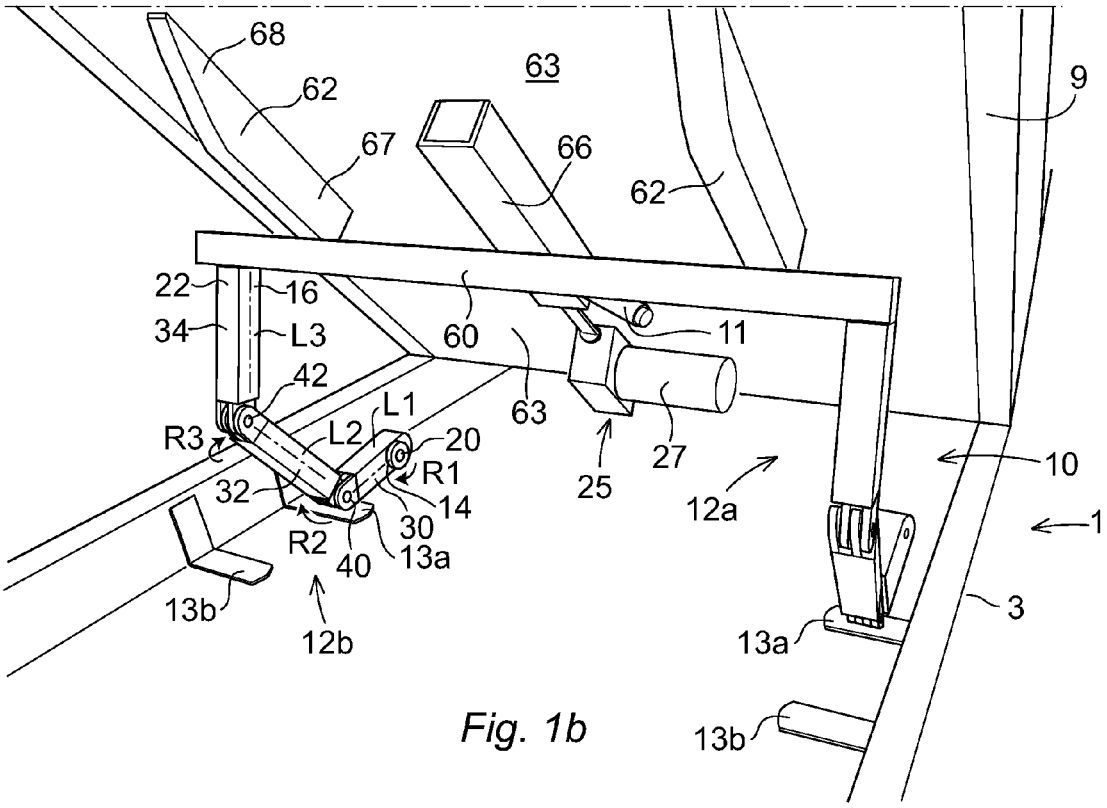
FIG. 1*b* shows a pivoting mechanism at a second section of the furniture device according to an embodiment of the invention.

The furniture device 1 is now to be described with reference to FIG. 1*a*-1*b*. The pivoting member 10 comprises a pivot arm 12*a* and a further pivot arm 12*b*. The two pivot arms 12*a*, 12*b* are arranged so that they extend essentially parallel with two opposite directed sides of the furniture device 1. The two pivot arms 12*a*, 12*b* have essentially the same structural design.

The furniture device 1 further comprises a first support 13*a* and a second support 13*b* for each of the pivot arms 12*a*, 12*b*. The first support 13*a* and the second support 13*b* protrude out from the fundament 3. The first support 13*a* and the second support 13*b* are adapted to support the pivot arm 12*a*, 12*b* while pivoting the furniture device and while being in a stationary position.

Each of the pivot arms 12*a*, 12*b* comprise a first end 14 and a second end 16. The pivoting member 10 further comprises a first pivot 20, which first pivot 20 is connecting the first end 14 of each of the pivot arm 12*a* and the further pivot arm 12*b* to the fundament 3. The first pivot 20 is adapted to allow a first rotation R1 of the pivot arms 12*a*, 12*b* in relation to the fundament 3.

Each of the pivot arm 12*a* and the further pivot arm 12*b* comprises an elongated first arm 30, an elongated second arm 32 and an elongated third arm 34. The first arm 30 is closer to the first pivot 20 than the second arm 32.

The first arm 30 and the second arm 32 is connected by means of a second pivot 40, which second pivot 40 is adapted to allow a second rotation R2 of the second arm 32 in relation to the first arm 30.

Each of the pivot arm 12*a* and the further pivot arm 12*b* comprises a third pivot 42, which third pivot 42 is adapted to connect the third arm 34 to the second arm 32. The third pivot 42 is adapted to allow a third rotation R3 of the third arm 34 in relation to the second arm 32.

The first arm 30 is adapted to be supported by the first support 13*a*. The second arm 32 is adapted to be supported by the second support 13*b*.

The pivoting member 10 further comprises a connection element 60. The second ends 16 of the pivot arm 12*a* and the further pivot arm 12*b* are connected by means of the connection element 60.

The pivoting member 10 further comprises two guide members 62. Each of the guide members 62 comprises a wedge formed member that is attached to a lower surface 63 of the second section 9, which lower surface is directed towards the fundament 3 when the device 1 is oriented in the first orientation. The guide member 62 comprises an inner portion 67 and outer portion 68. The inner portion 67 is located closer to the motor unit 27 than the outer portion 68.

Moreover, the furniture device 1 comprises a link arm 11 The link arm 11 extends from a fourth pivot 15 between the link arm 11 and the outer part 22 of the pivot arm 12*a* to a fifth pivot 17 between the link arm 11 and the second section 9.

By means of the fourth pivot 15 and the fifth pivot 17 the second section 9 is adapted to be to be pivoted independently from the pivoting movement provided by the pivoting member 10. By means of the link arm 11, it is assured that a person is not pinched between the second section 9 and the fundament 3. A person located between the second section 9 and the fundament 3 will only be subjected to the weight of the second section 9. Thereby, no sensors are necessary to avoid a person from being pinched between the second section 9 and the fundament 3.

The connection element 60 is adapted to slide on the guide member 62, wherein the guide member 62 guides the pivoting movement of the second section 9 in relation to the first section 7.

The pivoting member 10 further comprises a pivoting mechanism 25, which pivoting mechanism 25 is adapted to induce the first rotation R1, the second rotation R2 and the third rotation R3. The pivoting mechanism 25 comprises a motor unit 27, such as an electric motor. The motor unit 27 is attached to the lower surface 63 of the second section 9. The lower surface 63 of the second section 9 is directed towards the fundament 3 when the device 1 is oriented in the first orientation.

The motor unit 27 is adapted to act on an outer part 22 of the pivot arms 12*a* 12*b* so that the second section 9 is pivoted in relation to the first section 7. The outer part 22 is located at the second end 16 of the pivot arms 12*a*, 12*b*.

In the disclosed embodiment the pivoting mechanism 25 is adapted to act on the connection element 60, which connection element 60 is connected to the third arm 34. The pivoting mechanism 25 is adapted to pull or push the outer part 22 towards or away from the motor unit 27.

The connection element 60 comprises a groove 64 adapted to be connected to a displacement member 66, such as a screw, guide rail, etcetera. The displacement member is powered by the motor unit 27, wherein the connection element 60 is displaced toward or away from the motor unit 27.

Figure 2A:
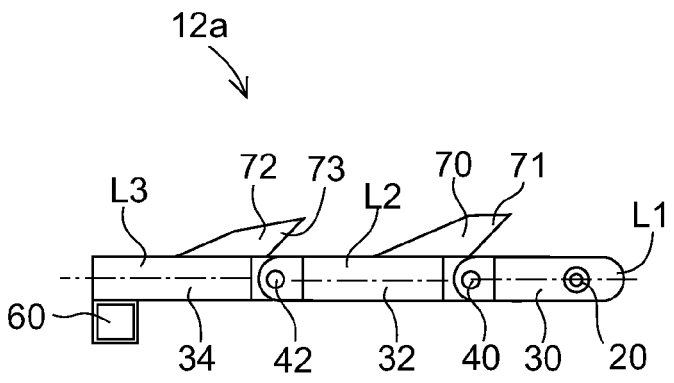
FIG. 2*a*-2*c* shows a pivot arm according to an embodiment of the invention.
Figure 2B:
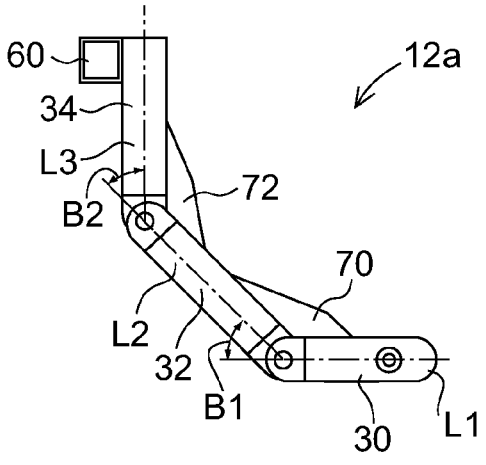
Figure 2C:
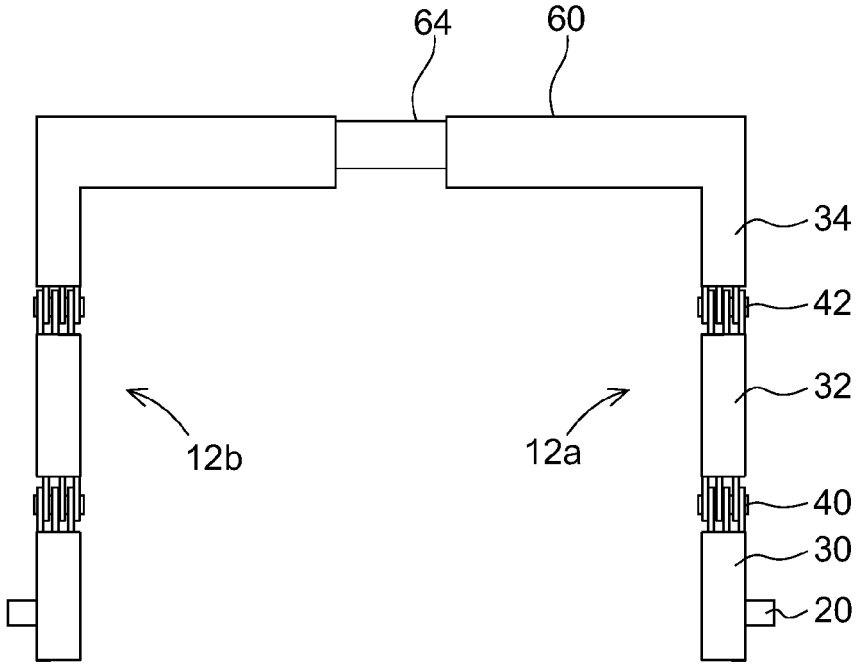

FIG. 2*a*-2*c* presents different views of the pivot arm 12*a*, the further pivot arm 12*b* and the connection element 60. The first arm 30 extends along a first longitudinal axis L1.

The second arm 32 extends along a second longitudinal axis L2. The second rotation R2 is adapted to be initiated when the second longitudinal axis L2 is essentially parallel with the first longitudinal axis L1 or oriented up to at a first angle C1 with the first longitudinal axis L1, see FIGS. 4 and 5.

The first rotation R1 is adapted to be initiated when the second longitudinal axis L2 is oriented at a second angle C2 with the first longitudinal axis L1, see FIGS. 5 and 6. The second angle C2 is larger than the first angle C1.

The second arm 32 comprises a first stop member 70 which first stop member 70 is adapted to stop the second rotation R2 at a first inclination B1 between the second longitudinal axis L2 and the first longitudinal axis L1. The first stop member 70 protrudes away from the second longitudinal axis L2 of the second arm 32. The first stop member 70 comprises a first side part 71 which first side part 71 is adapted to abut the first arm 30 at the first inclination B1 between the second longitudinal axis L2 and the first longitudinal axis L1. See FIG. 2*a*.

The third arm 34 extends along a third longitudinal axis L3. The third rotation R3 is adapted to be initiated when the third longitudinal axis L3 is essentially parallel with the second longitudinal axis L2 or oriented up to at a third angle C3 with the second longitudinal axis L2, see FIGS. 3 and 4.

The second rotation R2 is adapted to be initiated when the third longitudinal axis L3 is oriented at a fourth angle C4 with the second longitudinal axis L2, wherein the fourth angle C4 is larger than the third angle C3, see FIG. 4. The fourth angle C4 is larger than the third angle C3.

The third arm 34 comprises a second stop member 72 which second stop member 72 is adapted to stop the third rotation R3 at the second inclination B2 between the third longitudinal axis L3 and the second longitudinal axis L2.

The second stop member 72 protrudes away from the third longitudinal axis L3 of the third arm 34. The second stop member 72 comprises a second side part 73 which second side part 73 is adapted to abut the second arm 32 at the second inclination B2 between the third longitudinal axis L3 and the second longitudinal axis L2. See FIG. 4.

In FIG. 2*a* the first second longitudinal axis L1, the second longitudinal axis L2 and the third longitudinal axis L3 are essentially parallel. Accordingly, the pivot arm 12*a* positioned so that the second section 9 is in the first orientation.

In FIG. 2*b* the first second longitudinal axis L1, the second longitudinal axis L2 and the third longitudinal axis L3 are non-parallel and the second rotation R2 and third rotation R3 is stopped in the first inclination B1 and the second inclination B2 respectively. Accordingly, the pivot arm 12*a* is positioned so that the second section 9 is in essentially the third orientation.

In FIG. 2*c* the pivot arm 12*a* and the further pivot 12*b* arm is shown from a top view. The two pivot arms 12*a*, 12*b* is connected by the connection member 60.

The motor unit 27 is attached to the lower surface 63 of the second section 9. From the first orientation the motor unit 27 is adapted to pull the outer part 22 of each of the pivot arms 12*a*, 12*b* so that the third rotation R3 is induced, which third rotation R3 rotates the second section 9 from the first orientation to the second orientation.

From the second orientation the motor unit 27 is adapted to pull the outer part 22 of each of the pivot arms 12*a*, 12*b* so that the second rotation R2 is induced, which second rotation R2 rotates the second section 9 from the second orientation to the third orientation.

From the third orientation the motor unit 27 is adapted to pull the outer part 22 of each of the pivot arms 12*a*, 12*b* so that the first rotation R1 is induced, which first rotation R1 rotates the second section 9 from the third orientation to the fourth orientation.

FIG. 3-6 shows side views of the furniture device in FIG. 1, where the second section 9 is arranged in the first, the second, the third and the fourth orientation respectively. The pivot arm 12*a*, 12*b* is shown in solid line and dashed line in FIG. 4-6. The solid line represents the real position of the pivot arm 12*a*, 12*b* in the figure. The dashed line in FIG. 4-6 represents the position of the pivot arm 12*a*, 12*b* in the previous figure.

The arrow between the pivot arm 12*a*, 12*b* in solid line and dashed line represents how the arms 30, 32, 34 of the pivot arm 12*a*, 12*b* are rotated by means of the third rotation R3 (as from FIG. 3 to FIG. 4), the second rotation R2 (as from FIG. 4 to FIG. 5) and the first rotation R1 (as from FIG. 5 to FIG. 6).

Figure 3:
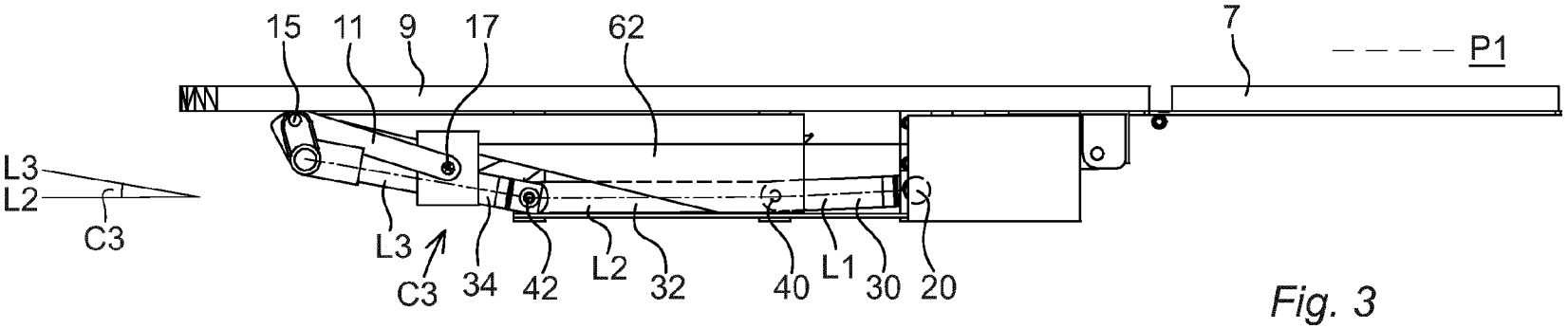
FIG. 3 shows a side view of the furniture device in FIG. 1 in the first orientation.

In FIG. 3 the second section 9 is oriented in the first orientation. The pivoting mechanism 25 is adapted to act on the outer part 22 of a pivot arm 12 so that a third rotation R3 is induced. The third rotation R3 rotates the second section 9 from the first orientation to the second orientation.

In FIG. 4 the second section 9 is oriented in the second orientation. In the second orientation the second section 9 is inclined at the first angle A1 with the first plane P1. The pivoting mechanism 25 is adapted, from the second orientation, to act on the outer part 22 of the pivot arm 12 so that the second rotation R2 is induced. The second rotation R2 rotates the second section 9 from the second orientation to a third orientation.

In FIG. 5 the furniture device 1 is oriented in the third orientation. In the third orientation the second section 9 is inclined at a second angle A2 with the first plane P1, wherein the second angle A2 is higher than the first angle A1. The pivoting mechanism 25 is adapted, from the third orientation, to act on the outer part 22 of a pivot arm 12 so that the first rotation R1 rotates the second section 9 from the third orientation to a fourth orientation.

In FIG. 6 the furniture device 1 is oriented in the fourth orientation. In the fourth orientation the second section 9 in inclined at a third angle A3 with the first plane P1, wherein the third angle A3 is higher than the second angle A2. In an embodiment of the invention, the second section is adapted to be pivoted so that the third angle A3 becomes 90 degrees.

The present invention is not limited to the embodiments disclosed but may be varied and modified within the scope of the following claims.

The invention claimed is:

1. A furniture device comprising:

a fundament in connection to the ground, a support member on the fundament, the support member comprising a first section having a first surface parallel with a first plane and a second section having a second surface, wherein the second section is adapted to be pivoted between a first orientation and a second orientation, the second surface being parallel with the first plane in the first orientation and non-parallel with the first plane in the second orientation, a pivoting member adapted to pivot the second section between the first and the second orientation, the pivoting member comprising at least one pivot arm with a first end and a second end, a first pivot between the first end of the at least one pivot arm and the fundament adapted to allow a first rotation of the at least one pivot arm in relation to the fundament so that the second end of the at least one pivot arm acts on the second section, and a pivoting mechanism adapted to induce the first rotation, wherein the at least one pivot arm comprises an elongated first arm and an elongated second arm, wherein the first arm is closer to the first pivot than the second arm, and a second pivot between the first arm and the second arm adapted to allow a second rotation of the second arm in relation to the first arm, wherein the pivoting mechanism is adapted to act on an outer part of the at least one pivot arm, which outer part is located at a greater distance from the first pivot than the second pivot, resulting in that the second rotation is initiated prior to the first rotation.

2. The furniture device according to claim 1, wherein the elongated first arm extends along a first longitudinal axis and the elongated second arm extends along a second longitudinal axis, wherein the first rotation is consecutive to the second rotation when the second section is pivoted away from the first orientation, and wherein the second rotation is adapted to be initiated when the second longitudinal axis is parallel with the first longitudinal axis or oriented up to at a first angle with the first longitudinal axis and the first rotation is adapted to be initiated when the second longitudinal axis is oriented at a second angle with the first longitudinal axis, wherein the second angle is larger than the first angle.

3. The furniture device according to claim 2, wherein the second arm comprises a first stop member adapted to stop the second rotation at a first inclination between the second longitudinal axis and the first longitudinal axis.

4. The furniture device according to claim 3, wherein the first stop member protrudes away from the second longitudinal axis of the second arm, wherein the first stop member comprises a first side part adapted to abut the first arm at the first inclination between the second longitudinal axis and the first longitudinal axis.

5. The furniture device according to claim 1, wherein the pivot arm comprises an elongated third arm, wherein the second arm is closer to the first pivot than the third arm, and a third pivot between the second arm and the third arm adapted to allow a third rotation of the second arm in relation to the first arm, wherein the pivoting mechanism is adapted to act on the outer part of the at least one pivot arm, which outer part is located at a greater distance from the first pivot than the third pivot, so that the pivoting mechanism induces the third rotation.

6. The furniture device according to claim 5, wherein the elongated third arm extends along a third longitudinal axis, wherein the second rotation is consecutive to the third rotation when the second section is pivoted away from the first orientation, and the third rotation is adapted to be initiated when the third longitudinal axis is parallel with the second longitudinal axis or oriented up to at a third angle with the second longitudinal axis and the second rotation is adapted to be initiated when the third longitudinal axis is oriented at a fourth angle with the second longitudinal axis, wherein the fourth angle is larger than the third angle.

7. The furniture device according to claim 6, wherein the third arm comprises a second stop member adapted to stop the third rotation at a second inclination between the third longitudinal axis and the second longitudinal axis.

8. The furniture device according to claim 7, wherein the second stop member protrudes away from the third longitudinal axis of the third arm, wherein the second stop member comprises a second side part adapted to abut the second arm at the second inclination between the third longitudinal axis and the second longitudinal axis.

9. The furniture device according to claim 5, wherein the pivoting mechanism is adapted to, from the first orientation, act on the at least one pivot arm so that the third rotation is induced, which third rotation rotates the second section from the first orientation to the second orientation.

10. The furniture device according to claim 1, wherein the pivoting mechanism is adapted, from the second orientation, to act on the at least one pivot arm so that the second rotation is induced, which second rotation rotates the second section from the second orientation to a third orientation, wherein in the second orientation the second section is inclined at a first angle with the first plane and in the third orientation the second section is inclined at a second angle with the first plane, the second angle being higher than the first angle.

11. The furniture device according to claim 10, wherein the pivoting mechanism is adapted, from the third orientation, to act on the at least one pivot arm so that the first rotation rotates the second section to a fourth orientation, wherein the fourth orientation is inclined at a third angle with the first plane and the third angle is higher than the second angle.

12. The furniture device according to claim 1, wherein the pivoting mechanism comprises a motor unit attached at the second section, wherein the motor unit is pulling the at least one pivot arm towards the motor unit when the second section is pivoted from the first orientation to the second orientation and the motor unit is pushing the pivot arm away from the motor unit when the second section is pivoted from the second orientation to the first orientation.

13. The furniture device according to claim 1, wherein the device comprises a further pivot arm, each pivot arm being connected to opposite sides of the fundament by means of the first pivot, and a connection element connecting the two pivot arms together, wherein the connection element is adapted to act on the second section.

14. The furniture device according to claim 13, wherein the second section comprises a guide member protruding towards the fundament, wherein the connection element is adapted to slide on the guide member.

15. The furniture device according to claim 1, wherein the furniture device comprises a link arm extending from a fourth pivot between the link arm and the outer part of the at least one pivot arm to a fifth pivot between the link arm and the second section.

* * * * *